United States Patent [19]

Haraden et al.

[11] 4,406,969

[45] Sep. 27, 1983

[54] CIRCULAR FLUORESCENT LAMP HOLDER

[75] Inventors: Thomas Haraden, Ipswich; Harold L. Hough, Beverly, both of Mass.

[73] Assignee: GTE Products Corporation, Stamford, Conn.

[21] Appl. No.: 329,909

[22] Filed: Dec. 11, 1981

[51] Int. Cl.[3] ..... H01J 5/48; H01J 5/50

[52] U.S. Cl. ..... 313/318; 315/53; D26/93; 362/410

[58] Field of Search ..... 313/49, 318, 324; 339/1 L, 2 L, 2 A, 6 R, 6 A, 8 PS, 68, 112 R; 315/53, 57, 58; 362/216, 362, 370, 373, 410, 412, 413, 414, 417, 418; 336/55, 59; D26/42, 93

[56] References Cited

U.S. PATENT DOCUMENTS 4,278,911 7/1981 Metoff ..... 313/318

*Primary Examiner*—Alfred E. Smith
*Assistant Examiner*—Robert E. Wise
*Attorney, Agent, or Firm*—William H. McNeill

[57] ABSTRACT

A holder for circular fluorescent lamps has a central body with a pair of arms terminating in lamp holding means. The lamp holding means include lamp receiving openings which are arrayed orthogonal to one another.

3 Claims, 2 Drawing Figures

CIRCULAR FLUORESCENT LAMP HOLDER

TECHNICAL FIELD

This invention relates to holders for fluorescent lamps, in particular, circular lamps. Still more particularly, the invention relates to lamp holders which can be employed for utilizing fluorescent lamps in incandescent sockets.

BACKGROUND ART

Because of the increasing cost of electrical energy, the substitution of costlier, but more energy efficient, fluorescent lamps in place of incandescent lamps has become practical. A prime candidate for this substitution is the circular fluorescent lamp, primarily because of its more compact size when compared with the more typical elongated fluorescent lamp.

Common to most structures employed for this purpose are a central hub which can include a ballast and having projecting therefrom means to hold the lamp. For example, U.S. Pat. No. 2,298,961 describes such an assembly having a single arm to hold the lamp. Such a device leaves a major portion of the lamp totally unsupported. U.S. Pat. No. 2,817,004 shows another such device wherein the lamp is held by spring clips; however, the device must be disassembled to replace the lamp. Still another is shown in U.S. Pat. No. D. 259,961, wherein the lamp is supported by three arms and also is difficult to replace. Yet another example is depicted in U.S. Pat. No. 4,278,911. In the latter patent the lamp is permanently fixed to a plastic ring having at least one hollow arm which includes some of the starting circuitry. In the event of lamp failure, this entire unit must be replaced.

DISCLOSURE OF INVENTION

It is, therefore, an object of this invention to obviate the disadvantages of the prior art.

It is another object of the invention to provide a lamp holder which provides support for the lamp regardless of the manner in which the holder is positioned.

Still another object is the provision of a holder whose lamp is easily replaceable.

These objects are accomplished, in one aspect of the invention, by a holder for a circular lamp which comprises a central body having a longitudinal axis. A pair of diametrically opposed arms project from the body and terminate in lamp holding means. Lamp receiving openings are formed as part of said lamp holding means, with each of the openings being disposed about its own axis. A first of said openings has its axis parallel to the axis of the central body, and the other opening has its axis normal to the axis of the central body. This arrangement of the openings provides support for the lamp regardless of the orientation of the holder; i.e., base up, base down or base horizontal. The lamp is easily replaceable in the event of failure and only the lamp itself has to be replaced.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
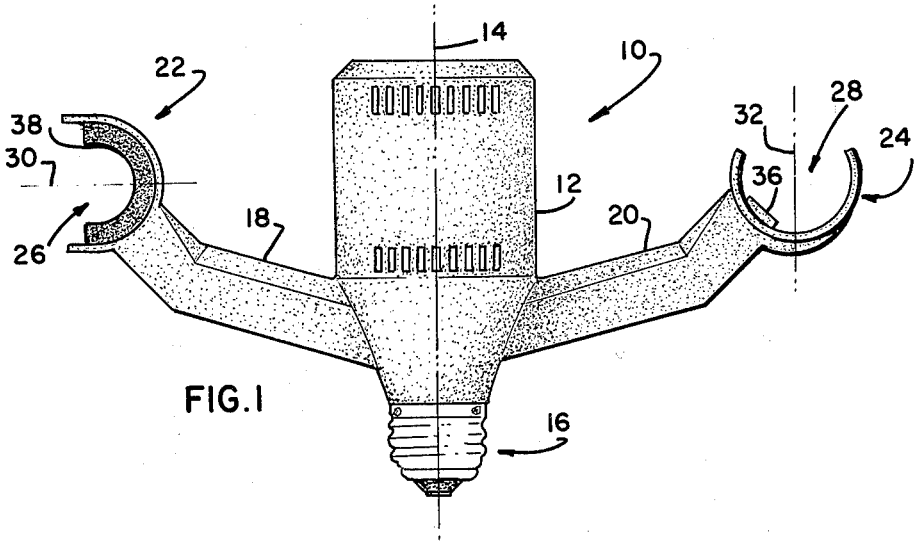
FIG. 1 is an elevational view of the invention without a lamp.
Figure 2:
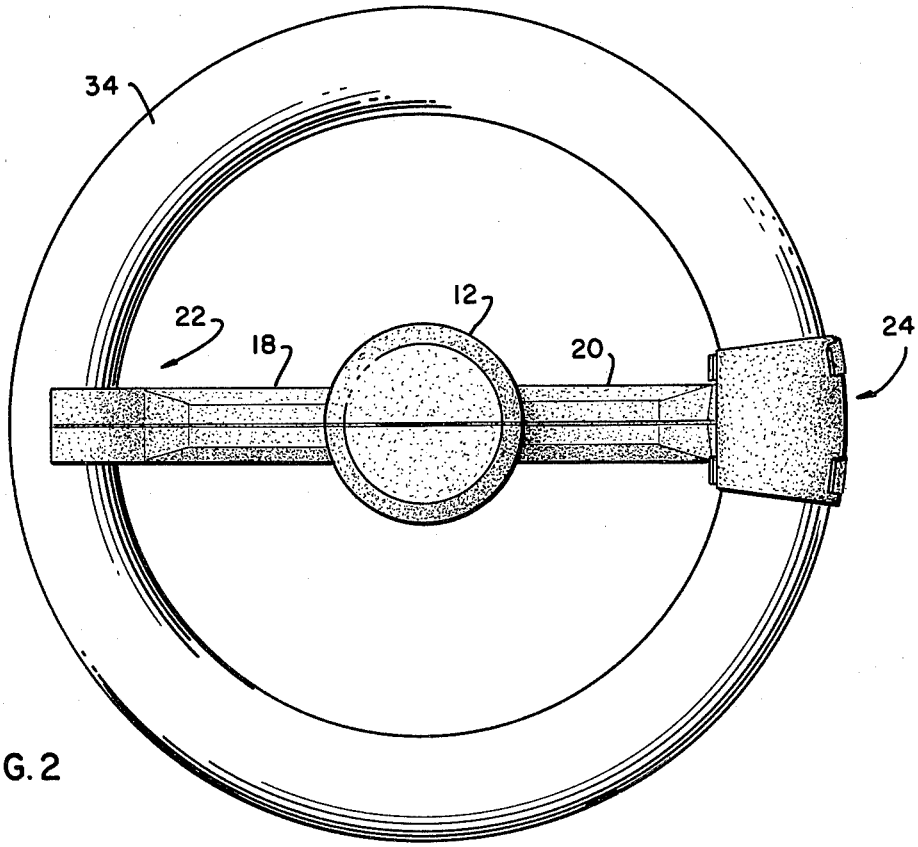
FIG. 2 is a plan view of the invention with a lamp in position.

Referring now to the drawings with greater particularity, in FIG. 1 there is shown a holder 10 for a circular (for example, fluorescent) lamp. Holder 10 has a central body 12 with a longitudinal axis 14. One end of the body 12 is provided with means 16 for connection to a source of power and can be a screw-in base.

A pair of diametrically opposed arms 18 and 20 project from body 12 and terminate in lamp holding means 22 and 24. Lamp holding means 22 is provided with a lamp receiving opening 26, and lamp holding means 24 has a lamp receiving opening 28.

The lamp receiving openings 26 and 28 are each disposed about their own axis. Opening 26, for example, is disposed about an axis 30 which is normal to longitudinal axis 14, and opening 28 is disposed about an axis 32 which is parallel to longitudinal axis 14.

The orthogonal arrangement of the openings 26 and 28 relative to one another thus insures adequate positional support for the lamp 34 regardless of the mounting position of the holder.

Lamp socket receiving means 36 are positioned in the bottom of holding means 24 for engaging the connecting means provided with lamp 34, and cushioning means in the form of an arcuate compressible foam member 38 is provided within holding means 26.

A lamp 34 is inserted into the holder 10 by first fitting the side of lamp opposite the lamp connecting means into lamp receiving opening 26 and then swinging the lamp into engagement with lamp receiving opening 28 and consumating the electrical connection between the lamp and the lamp socket receiving means 36.

While there have been shown and described what are at present considered to be the preferred embodiments of the invention, it will be apparent to those skilled in the art that various changes and modifications can be made herein without departing from the scope of the invention as defined by the appended claims.

We claim:

1. A holder for a circular lamp, said holder comprising: a central body having a longitudinal axis; a pair of diametrically opposed arms projecting from said body and terminating in lamp holding means; and lamp receiving openings in said lamp holding means, each of said openings being disposed about its own axis, a first of said opening having its axis parallel to said longitudinal axis and the other of said openings having its axis normal to said longitudinal axis.

2. The holder of claim 1 wherein said first of said openings contains lamp socket receiving means in the base thereof.

3. The holder of claim 1 wherein said other of said openings is fitted with a compressible foam member.

* * * * *